US005116469A

United States Patent [19]

Yahalom

[11] Patent Number: 5,116,469

[45] Date of Patent: May 26, 1992

[54] METHOD FOR TREATMENT OF HIGH-STRENGTH METAL AGAINST HYDROGEN EMBRITTLEMENT

[75] Inventor: Joseph Yahalom, Haifa, Israel

[73] Assignee: Technion Research and Development Foundation Ltd., Haifa, Israel

[21] Appl. No.: 302,251

[22] Filed: Jan. 27, 1989

[51] Int. Cl.[5] ..... C25C 1/00; C25F 1/00

[52] U.S. Cl. ..... 204/147; 204/196; 204/140

[58] Field of Search ..... 204/293, 196, 147, 140, 204/290 F, 130, 38.3

[56] References Cited

U.S. PATENT DOCUMENTS

| | | | |
|---|---|---|---|
| 3,147,204 | 9/1964 | Shepard et al. | 204/147 |
| 3,208,925 | 9/1965 | Hutchison et al. | 204/147 |
| 3,864,220 | 2/1975 | Denning et al. | 204/38.3 |
| 3,909,370 | 9/1975 | Videm et al. | 204/32.1 |
| 4,529,487 | 7/1985 | Hsu et al. | 204/44.2 |
| 4,533,606 | 8/1985 | Teng et al. | 204/44.2 |
| 4,801,368 | 1/1989 | Yamashita et al. | 204/293 |

*Primary Examiner*—John Niebling
*Assistant Examiner*—Arun S. Phasge
*Attorney, Agent, or Firm*—Foley & Lardner

[57] ABSTRACT

A method is described for treating high strength metals selected from zirconium, titanium and alloyed steels, against hydrogen embrittlement. The method involves the immersion of the metal in an electrolyte solution and subjecting it to an anodic potential having a value of up to 600 volts on the hydrogen scale. According to a preferred embodiment prior to the immersion, the metal is coated with a substance possessing a low hydrogen over-potential and high affinity towards hydrogen. The method removes continuously or periodically the hydrogen from the metal by anodic oxidation and minimizes the penetration of hydrogen into the core of the metal.

16 Claims, No Drawings

METHOD FOR TREATMENT OF HIGH-STRENGTH METAL AGAINST HYDROGEN EMBRITTLEMENT

The present invention relates to a method for the treatment of high strength metals against hydrogen embrittlement. More particularly the invention relates to a method for the treatment of zirconium, titanium and alloyed steels against hydrogen embrittlement.

BACKGROUND OF THE INVENTION

As known high strength metals such as zirconium and zirconium alloys, titanium and titanium alloys, alloyed steels and others become brittle when exposed to elementary hydrogen.

This embrittlement is known to be associated with the penetration of hydrogen atoms into the metal lattice and has been the subject of extensive research. In spite of the considerable efforts to understand and thus combat hydrogen embrittlement, this phenomenon is still a major cause of failure of vital equipment such as heat transfer piping in nuclear power plants made of zirconium alloys, supersonic aircraft segments made of titanium alloys and machine parts such as bolts and shafts made of alloyed steels.

Efforts have been made in the past to overcome this catastrophic phenomenon by two main methods. The first method is trying to block the ingress of hydrogen atoms into the metal by the use of coatings as diffusion barriers. The second method is by attempting to drive the hydrogen out from the metals by a subsequent heat treatment.

The first method has largely failed due to the extremely high permeability of hydrogen through most coating materials. Palladium coatings might be theoretically considered in view of its excellent properties and reasonable surface hardness, but commercially attractive processes for applying palladium films require high plating rates. But such plating rates often lead to undesirable film properties. In many such processes the palladium film is found to be brittle and susceptible to cracking.

The second method which requires a subsequent heat treatment is impractical for many parts which are too big to be introduced into a furnace, or are damaged by the heat treatment temperature.

It is an object of the present invention to provide a simple method for the treatment of high strength metals against hydrogen embrittlement. It is another object of the present invention to provide a simple method for the treatment of high strength metals against hydrogen embrittlement by an electro-chemical oxidation process. It is yet another object of the present invention to provide a simple method for the treatment of vital equipment made of a high strength metal against hydrogen embrittlement.

BRIEF DESCRIPTION OF THE INVENTION

The invention relates to a method for the treatment of high strength metals selected from the group consisting of zirconium, titanium and alloyed steels, against hydrogen embrittlement which consists of the immersion of the respective high strength metal in an electrolyte solution and subjecting it to an anodic potential having a value of up to 600 millivolts on the hydrogen scale. The preferred range of anodic potential is between 50 millivolts to 150 millivolts on that scale.

The advantages of the preferred embodiments of the present invention are: (1) removing periodically or continuously the hydrogen from the metal surface by anodic oxidation and (2) minimizing the penetration of hydrogen into the core of the metal.

According to the invention, pipes, rods, plates, fittings or various parts of equipment made of titanium, zirconium or alloyed steels are immersed in an electrolyte solution to which the respective anodic potential of up to 600 volts on the hydrogen scale is applied to the treated metal against another electrode used as a cathode; additionally a reference electrode can also be used for monitoring the metal potential. This treatment can be carried out either periodically at maintenance times, or continuously during service in environments which may produce hydrogen. The pH of the electrolyte solution may vary over large limits depending on the specific high strength metal. Thus, for instance, in case of zirconium and titanium or alloys thereof, this treatment is carried out in a solution having a pH in the range of 2 to 14. In case of alloyed steels, the solution has preferably a pH in the range of 8 to 12; a pH below 8 might cause some dissolution of iron. The alkaline pH values are achieved by using a dilute solution of a common alkaline compound such as potassium carbonate, sodium carbonate, alkaline phosphate salts etc. Of course the presence of aggresive ions such as chlorides and bromides should be avoided in order to prevent local corrosion attack of the metal during the anodic treatment.

According to a preferred embodiment a prior coating is carried out on the high strength metal before the electrochemical oxidation treatment. This coating is performed with a substance possessing a low hydrogen over potential and high affinity towards hydrogen. Typical examples of such substances are zinc, tin and most preferred is nickel. The coating will form a passive film through which the hydrogen will not penetrate into the core of the high strength metal and could be easily removed by anodic oxidation, with very little overpotential. Preferred thickness of the coating is in the range of 1–2 micrometers.

The anodic current varies, at a constant potential of about 100 mV (on the hydrogen scale), between 500 mA/sq.cm. and 1 uA/sq.cm. depending on the amount of hydrogen left in the metal, on the applied potential and the pH.

The anode potential for the anode oxidation may be controlled in a variety of ways. For example, the voltage between the treated metal and the cathode could be measured with a voltmeter and the electrolytic current adjusted manually to ensure that the anode electrode potential is greater than the hydrogen electrode potential for the electrolyte. Here, the anode electrode potential can be derived either indirectly by substracting out the potential drop from the cathode electrode and other sources, or against a reference electrode such as silver-silver chloride electrode.

The anodic oxidation, proceeds in two stages:

In the first stage, occurs the oxidation of hydrogen absorbed on the metal surfaces.

In the second stage, occurs the oxidation of the internal hydrogen in the core metal.

In case that a prior coating is applied, after the first stage, there is an intermediate stage in which occurs the oxidation of the internal hydrogen on the coated metal; hydrogen diffuses at this stage through the coating to the outer surface where it is oxidized.

The treatment time depends on the hydrogen content of the metal but is generally in the ranges of 1-5 minutes for stage 1 and about 1 to 5 hrs for stage 2 and also 1 to 5 hrs for the removal of hydrogen from the coating when this is applied thereto.

The oxidation is performed for the zirconium metal in any aqueous solution such as the normal cooling water in the heat transfer piping, in nuclear power plants. It also can be performed for titanium alloys of supersonic aircraft segments in any electrolyte solution.

The process can be controlled in a variety of ways. A constant voltage can be applied accross the electrodes so that the anode potential on the hydrogen scale is close to, but not in excess of the oxidation potential of the coating substance on the hydrogen scale. A particularly preferred method of controlling the electrode potential is by the use of a potentiostat. The potentiostat is a controller circuit which maintains the potential value between anode electrode and reference electrode equal to a desired potential. Some types of potentiostats are described in a number of references including: Experimental electrochemistry for Chemists by D. T. Savyer et al (J. Wilery and Sons, N.Y. pages 256-269); W. M. Schwartz et al (Anal. Chem, 35, 1770, 1963) etc. Alternatively, the process may be controlled galvanostatically—at a constant current—and the voltage between the treated metal and reference electrode monitored and not allowed to exceed the limits set forth above.

I claim:

1. A method for the removal of hydrogen from high strength metals, selected from the group consisting of zirconium, titanium and their alloys, against hydrogen embrittlement, consisting essentially of the steps of:

periodically immersing the high strength metal in a non-corrosive electrolyte solution during maintenance, subjecting the metal to an anodic potential having a value of up to 600 millivolts on the hydrogen scale, and removing elementary hydrogen that has diffused to the outer metal surface from the metal surface by anodic oxidation of hydrogen.

2. A method according to claim 1, wherein the anodic potential is in the range of between 50-150 millivolts on the hydrogen scale.

3. A method according to claim 1, wherein the high strength metal is coated with a substance having a low hydrogen over-potential and high affinity towards hydrogen.

4. A method according to claim 1, wherein the anodic current applied is in the range of between 500 mA/sq.cm. to 1 μA/sq.cm.

5. A method according to claim 1, wherein the zirconium and titanium are treated in an environment having a pH in the range of 2 to 14.

6. A method according to claim 3, wherein said substance used for coating is selected from zinc, nickel and tin.

7. A method according to claim 3, wherein the thickness of said coating is in the range of 1-2 micrometers.

8. A method according to claim 3, wherein the anodic potential is in the range of 50-150 millivolts on the hydrogen scale.

9. A method as claimed in claim 3, wherein the coating has a thickness of about 1 to 2 micrometers.

10. The method as claimed in claim 1, wherein the metal is in the form of a part from a nuclear reactor or an aircraft, said part being periodically subjected to the treatment during a maintenance time.

11. The method as claimed in claim 10, wherein the part is a zirconium or zirconium alloy nuclear reactor part.

12. The method as claimed in claim 10, wherein the part is a titanium or titanium alloy aircraft part.

13. The method as claimed in claim 11, wherein the part is heat transfer piping from a nuclear reactor.

14. A method for the treatment of high strength metals selected from the group consisting of zirconium, titanium and their alloys, against hydrogen embrittlement consisting essentially of the steps of immersing the high strength metal in an electrolyte solution, first subjecting the metal to an anodic potential having a value of up to 600 millivolts on the hydrogen scale for about 1 to 5 minutes to remove elementary hydrogen from the metal surface by anodic oxidation, and then subjecting the metal to an anodic potential having a value of up to 600 volts on the hydrogen scale for about 1 to 5 hours to remove elementary hydrogen from the metal core by anodic oxidation.

15. A method for the periodic maintenance treatment against hydrogen embrittlement of a zirconium or zirconium alloy part used in a nuclear reactor, consisting essentially of the steps of:

periodically removing a zirconium or zirconium alloy part from a nuclear reactor during a maintenance period, immersing the part in a non-corrosive electrolyte solution, subjecting the part to an anodic potential having a value of up to 600 millivolts on the hydrogen scale, removing elementary hydrogen from the metal surface of the part by anodic oxidation of hydrogen, and returning the part to the nuclear reactor.

16. A method for the treatment against hydrogen embrittlement of a titanium or titanium alloy part used in an aircraft, consisting essentially of the steps of:

periodically removing a titanium or titanium alloy part from an aircraft during a maintenance period, immersing the part in a non-corrosive electrolyte solution, subjecting the part to an anodic potential having a value of up to 600 millivolts on the hydrogen scale, removing elementary hydrogen from the metal surface of the part by anodic oxidation of hydrogen, and returning the part to the aircraft.

* * * * *

UNITED STATES PATENT AND TRADEMARK OFFICE

CERTIFICATE OF CORRECTION

PATENT NO. : 5,116,469

DATED : May 26, 1992

INVENTOR(S) : Joseph Yahalom

It is certified that error appears in the above-identified patent and that said Letters Patent is hereby corrected as shown below:

Title page, add item

[30] Foreign Application Priority Data

June 29, 1988 [Israel] Israel .....86905

Signed and Sealed this

Third Day of August, 1993

Michael K. Kirk

*Attest:*

MICHAEL K. KIRK

*Attesting Officer*

*Acting Commissioner of Patents and Trademarks*